United States Patent [19]

Knott

[11] 4,003,702

[45] Jan. 18, 1977

[54] METHOD FOR CARBONIZING CELLULOSE MATERIALS

[75] Inventor: Jean Knott, Polleur, Belgium

[73] Assignee: I.W.S. Nominee Company Limited, London, England

[22] Filed: Apr. 15, 1974

[21] Appl. No.: 461,133

[30] Foreign Application Priority Data

Apr. 25, 1973 Germany ..... 2320825

[52] U.S. Cl. ..... 8/140; 252/8.6

[51] Int. Cl.[2] ..... D01C 3/00; D01C 5/00

[58] Field of Search ..... 8/140

[56] References Cited

UNITED STATES PATENTS

| | | | |
|---|---|---|---|
| 3,537,810 | 11/1970 | Fleissner et al. | 8/140 |

FOREIGN PATENTS OR APPLICATIONS

| | | | |
|---|---|---|---|
| 1,078,734 | 3/1960 | Germany | 8/140 |
| 626,801 | 7/1948 | United Kingdom | 8/140 |
| 835,634 | 5/1960 | United Kingdom | 8/140 |

OTHER PUBLICATIONS

Kirk–Othmer, Encyclopedia of Chemical Technology, 2nd Edition, vol. I, pp. 218–220, 1963.

*Primary Examiner*—Allan Lieberman
*Attorney, Agent, or Firm*—Dennis P. Clarke

[57] ABSTRACT

Cellulosic material present in admixture with or as impurities in wool or other non-carbonizable fibres is carbonized by treating the fibre substrate, which may be in any form from loose fibre to fabric, with a solution of an anhydrous acid in an inert organic solvent. The treated fibrous substrate is then dried and can be beaten, rinsed and further dried if necessary. The preferred solvents are aliphatic hydrocarbons or chlorinated aliphatic hydrocarbons and the acid may be an inorganic acid such as hydrochloric acid or an organic acid such as trichloracetic acid. The method can be applied to unscoured or undesized wool, in which case the wool is cleaned at the same time as cellulosic materials are being carbonized. The solvent may advantageously contain up to 100 g/l trioxan. The method can be applied by impregnating the fibrous substrate with the organic solvent and subsequently exposing the impregnated substrate to the acid, which may be gaseous hydrogen chloride. Carbonization by this method is quicker and after-treatments are simpler. Carbonization can be immediately followed by dyeing.

11 Claims, No Drawings

METHOD FOR CARBONIZING CELLULOSE MATERIALS

The invention relates to a method for carbonising cellulose materials.

The carbonising in an aqueous solution cellulose materials, which inter alia are present as impurities in certain textile materials, particularly in wool, is known. It is a tedious method which requires a comparatively long carbonisation time. Moreover neutralisation of wool after carbonisation in an aqueous medium is difficult, particularly in the case of heavy and closely woven materials. In addition the physical and chemical properties of the wool can be more or less radically changed by the carbonisation. (The term "cabonisation of wool" as used herein is not quite correct, although it is used in most technical and scientific publications).

It is the problem underlying the present invention to find a new method for carbonising cellulose materials which would be less damaging to the substrate to be carbonised and which could be carried out simply, in a comparatively short time, inclusive of the required after-treatment.

Therefore the invention resides in a procedure for carbonising natural or synthetic cellulose materials which are present as a mixture or as impurities in wool and/or in synthetic fibres which cannot be carbonised, which is characterised in that the substrate to be carbonised is treated with a solution of an anhydrous acid in an inert organic solvent, the substrate is then wrung and dried and, if necessary, beaten and rinsed and dried.

For the purposes of the present invention, by carbonisable cellulosic materials are to be understood materials which can be decomposed by the known carbonisation method in aqueous solution, and which thus represent materials which are present as undesirable admixtures in the substrate to be carbonised. The most important substrate of this kind is wool which contains certain organic admixtures which are decomposed by carbonisation. The substrate can, however, contain synthetic fibres, e.g. polyester fibres, in addition to natural wool or exclusively as the substance to be retained, from which undesirable organic admixtures, e.g. cotton fibres, can be removed by carbonisation.

In accordance with the method of the present invention carbonisation does not take place in an aqueous medium, as in the known method, but is brought about in an essentially anhydrous solution of an anhydrous acid in an inert organic solvent. Contrary to expectations impregnation of the substrate with an organic solvent instead of an aqueous solution is much easier. Carbonisation time is reduced and the after-treatment, particularly washing, is made easier. It is also possible to combine several essential wool treatment processes with the carbonisation.

As anhydrous acids for carbonisation can be used substantially all organic and inorganic acids which are able to decompose the unwanted constituents of the substrate to be carbonised, but which do not noticeably damage the desired substrate. Especially for economic reasons and in view of their rapid destructive effect on the constituents to be carbonised, mineral acids are to be preferred, particularly hydrochloric acid. However organic acids can also be used, e.g. dichloroacetic acid and particularly trichloroacetic acid.

The organic solvents used are such as are inert to the acids used and to the substrate to be carbonised. For this reason hydrocarbons are preferred as solvents, particularly saturated aliphatic hydrocarbons. Examples of these are hexane and heptane. To avoid explosions and fires it is preferred to use non-combustible or difficultly combustible solvents (and acids). Therefore chlorinated hydrocarbons, preferably aliphatic, are preferred as solvents. Examples of these are perchloroethylene, trichloroethylene, 1,1,1-trichloroethane etc., or mixtures thereof. The use of such solvents makes possible the preparation of homogeneous solutions of organic acids which, especially when heated, decompose, i.e. carbonise, the cellulose material, surprisingly quickly. In view of its technical availability perchloroethylene is particularly favoured because its boiling point is sufficiently high for elevated working temperatures to be used, it dissolves adequate quantities of the especially preferred acid, hydrochloric acid, and it is easy on the large scale to prepare and purify it in sufficiently anhydrous form. The boiling point of perchloroethylene is about 120° C under normal pressure and at normal temperature approximately 0.09 mol of hydrochloric acid dissolves in 1 liter of perchloroethylene.

The method according to this invention can be carried out at room temperature. It is generally better, however, to apply the solution of the acid in the organic solvent to the substrate at an elevated temperature so as to accelerate carbonisation, i.e. to decompose the unwanted cellulose material more quickly. The upper temperature limit is naturally so determined that the desired substrate, e.g. wool, does not suffer noticeable damage. Generally, carbonisation can be carried out at temperatures up to about 70° C, but preferably up to about 50° C without damage to wool or other substrate.

Essentially from the same point of view the concentration of the acid in the impregnating or carbonising solution is adjusted. Generally, an adequate and rapid carbonisation is achieved when the acid content is from 0.01 to 0.5 mol, preferably 0.05 and 0.1 mol per liter of solvent in the impregnating solution. Acid concentrations of 0.03 to 0.3 mol per liter of solvent are especially preferred. The upper limit of concentration of the acid in the solvent sometimes depends on the solubility of the acid in the solvent, particularly when inorganic anhydrous acids such as hydrochloric acid are to be dissolved in the solvent. Acid and organic solvent are therefore naturally to be so chosen in relation to one another that sufficient acid will dissolve in the solvent.

The duration of carbonisation depends especially on the decomposing effect of the acid on the unwanted cellulose material, the concentration of the acid and the working temperature. The carbonisation, i.e. the treatment of the substrate with the solution of acid in the organic solvent should obviously be allowed to continue until all undesirable cellulose material is destroyed. A carbonisation time prolonged beyond that point is obviously undesirable because for economic reasons the carbonisation time should be kept as short as possible and also because, after the decomposition of the unwanted cellulose material, further treatment with the solution of acid in the organic solvent produces no further useful effect and at most may damage the substrate. Surprisingly, the time required for adequate carbonisation with the method according to the invention is surprisingly short as compared with the known method. It varies from about 0.2 to 10 minutes, but preferably from 1 to 5 minutes. As a rule when working at moderately elevated temperatures up to about 50° C adequate carbonisation is already achieved within 1 to 3 minutes. This is a great step forward as compared with the present method which requires a much longer carbonisation time. Another advantage of the method according to the invention is that in this method the neutralisation following carbonisation is much easier than with carbonisation in an aqueous medium by the known method.

As already mentioned above, in the method of the invention a solution of an anhydrous acid in an inert organic solvent is used. In principle this solution should contain no water. In some cases, however, for technical reasons a small quantity of water in the solution cannot be prevented. This should in general not be more than 1% by weight and preferably not more than 0.02% by weight. If necessary, the solvent can contain stabilisers to prevent, for example, polymerisation of the solvent. This is, for example, the case with perchloroethylene. For obvious reasons the chosen stabilisers must not adversely affect the properties of the substrate.

The method according to the present invention is carried out in detail as follows:

The substrate to be treated, e.g. wool, is impregnated with the solution of an anhydrous acid or a mixture of such acids in an inert organic solvent and then treated with the solution at the temperature and for the time specified above. The substrate is then wrung mechanically or perhaps by means of a centrifuge and then dried for recovery of the solvent. Drying accelerates the effect of the acid on the cellulose materials which become brittle. The substrate is then beaten in order to eliminate most vegetable impurities. This is followed by neutralisation where necessary. When carbonising fabrics ("materials") it is not always necessary to beat them. The method according to the invention can be used to carbonise textile materials, particularly of wool, in every possible form, e.g. as wool in the yolk, tops, fabrics, etc. The method of the invention is particularly suitable for carbonising flock wool (carded wool) and for treating woven fabrics. The physical and chemical properties of the wool remain practically unaffected by the method of carbonisation according to the invention.

The method of this invention has among others the advantage that certain processes used in treating the substrate to be carbonised can be combined together. In one special embodiment the method of the invention can be so carried out as to carbonise unscoured, sized and/or dirty wool. Accordingly in this case the wool is degreased, desized and/or cleaned simultaneously with carbonisation. There is thus no need to carry out these steps independently. This is a quite outstanding advantage technically. In the carbonisation of flock wool the process is thus greatly simplified by this technique. When carbonising fabrics, particularly woollen fabrics, the fabrics can be scoured or desized at the same time as they are carbonised, as shown in Table 1 below. Moreover, the method according to the invention, having regard to the rapidity and uniformity of impregnation of the material with the solvent containing the organic acid, represents a way of carbonising before dyeing, which is also a great advantage.

As already mentioned above the effect of the acid on the substrate is reinforced by drying. A satisfactory effect can usually be achieved by drying for up to 30 minutes, preferably for up to 15 minutes. The drying temperature must naturally not exceed the temperature at which the substrate may be damaged. A good effect is obtained when drying is carried out a up to 150° C, preferably at temperatures between 50° and 130° C. In the case of wool, temperatures in the range of about 100° to about 120° C in a well aired dryer are especially suitable.

TABLE 1

Various processes involved in dyeing fabrics to be carbonised: a comparison of the classical aqueous system and the solvent system according to the invention.

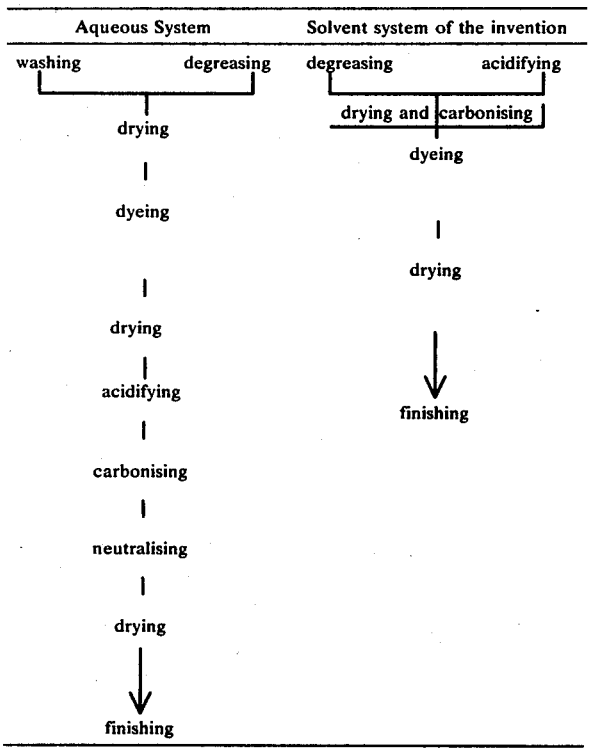

The invention is illustrated in greater detail by the following examples.

EXAMPLE 1

Perchloroethylene is saturated with gaseous hydrochloric acid to an HCl concentration in the solution of 0.08 nol/1; wool is then introduced into the solvent where it is left for 1 minute at a temperature below 50° C. The fabric is then wrung and dried for 10 minutes at 105° to 110° C in a ventilated dryer. This is followed by beating the wool in a conventional technical appliance in order to remove carbonised vegetable impurities. Finally the carbonised wool is rinsed in pure water at 20° C, or it is neutralised with a solution of 5 g of sodium carbonate in one liter and then rinsed in water at 20° C. At last the fabric is dried for 10 minutes at 85° to 90° C.

The chemical properties of the wool thus carbonised were then compared with those of a similar wool carbonised in an aqueous medium in the presence of sulphuric acid. The results obtained are given in Table 2 below.

A further advantage of the method according to the invention is that the neutralisation following carbonisation can be carried out much more easily than with carbonising in an aqueous medium according to the known method. Because of the small residual acid content of the carbonised substrate in carrying out the method according to the invention, it is possible to proceed to a dyeing without neutralisation since this as a rule takes place at about the same pH value as that of the carbonised substrate.

An especially advantageous embodiment of the method according to the invention, in proceeding on the industrial scale, is that in which the substrate to be carbonised is first impregnated with an inert organic solvent and the impregnated substrate is then treated with the anhydrous acid, especially gaseous hydrochloric acid. This method has the advantage that the solution of the anhydrous acid in the organic solvent does not have to be prepared in a special apparatus. Moreover, the method can be carried out in the usual apparatus which is available in carbonising plant.

According to a further preferred embodiment the inert organic solvent, especially perchloroethylene, contains up to 100 g/l., preferably up to 20 g/l., trioxan. By using this solvent mixture for the method of carbonising according to the invention, in the carbonisation of wool exceptionally low alkali and urea-bisulphite solubilites are achieved, and the resistance of the wool to heat is improved.

Table 2

| | Carbonisation in an aqueous medium | Carbonisation in a solvent medium |
|---|---|---|
| Percentage acid content after carbonisation | 6.8 | 0.82 |
| Percentage acid content after carbonisation and rinsing in water at 40° C (2 mins.) | 3.2 | 0.4 |
| Percentage acid content after carbonisation and neutralisation with $Na_2CO_3$ (5 g/l) | 0 | 0.1 |
| Solubility in alkali (%) | 26.1 | 20.8 |

The above results show that in the method of the invention a simple rinsing of the wool in water suffices to remove most of the acid on the fabric, in which respect an acid content of the order of 0.4% is acceptable and will not damage the wool during storage.

Moreover the alkali solubility results show that the decomposition of the wool by the acid during carbonisation is much smaller than with treatment in an aqueous medium.

EXAMPLE 2

In this example a top was carbonised in a solvent medium in order to be able to determine with greater accuracy the changes in physical and chemical properties suffered by the wool in the course of this treatment. In this experiment the top was only carbonised but not beaten or neutralised. The method of treatment was similar to that described in Example 1, but this time drying was carried out for 10 minutes at 105° C.

Wool with a relative humidity of 65% and wool dried for 80 minutes at 105° C were carbonised because the great affinity of hydrogen chloride for water could be a factor responsible for changes in the wool. The results obtained are summarised in Table 3 below.

Table 3

| Fabric | Before carbonisation | | After carbonisation | |
|---|---|---|---|---|
| | Acid, % | Solubility in alkali | Acid, % | Solubility in alkali |
| Wool at 65% relative humidity | | | | |
| Impregnation time | 0.1 | 16.0 | | |
| 30 seconds | | | 1.8 | 15.5 |
| 60 seconds | | | 1.4 | 16.6 |
| Dried wool | | | | |
| Impregnation time | 0.1 | 15.1 | | |
| 30 seconds | | | 0.31 | 15.6 |
| 60 seconds | | | 0.37 | 14.9 |

It was established that moist wool absorbed more acid than dry wool, but no change in the wool was detected in either case, as is shown by the alkali solubility results. The stretching of individual fibres under tension while wet and the stability of fibres were then examined. These results show no significant statistical differences between wool carbonised in accordance with the invention and untreated wool.

EXAMPLE 3

In this example wool fabrics were carbonised before dyeing in order to confirm that the treatment of the fabric in accordance with the invention produces uniform results and does not harmfully affect the quality of the subsequent dyeing. In the carbonisation of fabrics in aqueous media it is common to find great irregularities which result in poor uniformity (levelness) in the dyeing; for this reason hitherto carbonisation usually followed dyeing.

The impregnation of the fabric with the solvent perchloroethylene/HCl as well as the drying were carried out under various conditions in order to investigate the effect of impregnation and drying times on the quality of dyeing. The dyeing properties of the two samples (1 and 2) specified below were compared with those of the fabric itself (Sample 4) and those of the same fabric impregnated with pure perchloroethylene and dried for 5 minutes at 120° C before dyeing (Sample 3). The results of these analyses are shown in Table 4 following.

Table 4

| Sample | Impregnation Time with perchloro-ethylene/0.06N HCl | Expression | Drying time at 120° C | Dyeing |
|---|---|---|---|---|
| 1 | 30 seconds | 200 | 2 min. | Dyestuff: Alizarin Sky Blue R (2%); |
| 2 | 2 minutes | 200 | 5 min. | Dyebath ratio 1/20; |
| 3 | 2 minutes * | 200 | 5 min. | "Linitest" apparatus; |
| 4 | — | — | — | The fabric is introduced |

Table 4-continued

| Sample | Impregnation Time with perchloro-ethylene/0.06N HCl | Expression | Drying time at 120° C | Dyeing |
|---|---|---|---|---|
| | | | | at 40° C, then warmed to 90° C and dyed at that temperature for 60 minutes; the fabric was then rinsed in water and dried. |

*Impregnation with pure perchloroethylene.

Although the two carbonised Samples (1 and 2) were neither rinsed nor neutralised before dyeing they were found to be dyed very uniformly; no difference in the intensity of dyeing and no variations in shade could be detected in the two carbonised fabrics, in comparison with the two control fabrics. The dyestuff Alizarin Sky Blue R was chosen because of its sensitivity to strong acids.

EXAMPLE 4

To establish changes in cotton after carbonisation in a solvent medium, the degree of polymerisation of various samples was determined. This would indicate how strongly cotton was decomposed by treatment in accordance with the invention. Treatment conditions and the results thereby obtained are summarised in the following Table 5.

Table 5

| Sample | Impregnation time (sec.) | Normality of perchloroethylene/HCl | Drying time at 120° C (min.) | Degree of polymerisation |
|---|---|---|---|---|
| 1 not treated | — | — | — | 2 477 |
| 2 not treated, dried | — | — | 2 | 2 625 |
| 3 carbonised | 15 | 0.04 | 2 | 234 |
| 4 carbonised | 30 | 0.03 | 1 | 234 |
| 5 carbonised | 30 | 0.03 | 2 | 234 |
| 6 carbonised | 60 | 0.06 | 1 | 216 |
| 7 carbonised | 120 | 0.04 | 2 | 221 |

Note: All carbonised samples were wrung to an expression of the order of200% before the fabric was dried.

EXAMPLE 5

According to this Example, the method of carbonising is carried out in two stages. A wool fabric is first impregnated with perchloroethylene and then squeezed to achieve a squeezing effect of 100 to 150% as specified in the following Table 6. The impregnated material is then introduced for a period of 10 minutes into a chamber saturated with gaseous hydrogen chloride. It is then dried for 10 minutes at 120° C. After the carbonisation it was established that the colour of the wool had not changed. The values for alkali solubility after the treatment were similar to those obtained with the single stage method. In the following Table 6 are summarised the results obtained.

Table 6

| Sample | Squeezing effect (%) | Alkali Solubility (%) | Free acid content (%) |
|---|---|---|---|
| Untreated Wool | — | 11.8 | — |
| Carbonised Wool | 103 | 12.6 | 1.2 |
| Carbonised Wool | 132 | 12.1 | 1.5 |
| Carbonised Wool | 150 | 12.3 | 1.3 |

EXAMPLE 6

Wool was treated at 20° C for 1 minute with a mixture of perchloroethylene and the quantity of trioxan specified in Table 7, having a content off 0.06 N hydrochloric acid. It was then dried for 1 minute at 120° C. The results are summarised in the following Table 7.

TABLE 7

| | Wool after carbonisation | | | | | 1 hr. at 150° C | | | Heat resistance: 1 hr. at 130° C with water (pressure) | | | Heat resistance: 30 Seconds at 250° C | | |
|---|---|---|---|---|---|---|---|---|---|---|---|---|---|---|
| Trioxan content (g/l) | A.C. % | A.S. % | A.S. corr. % | U.B.S. % | U.B.S. corr. % | A.C. % | A.S. % | A.S. corr. % | A.C. % | A.S. % | A.S. corr. % | A.C. % | A.S. % | A.S. corr. % |
| 5 | 1.9 | 6.4 | 4.5 | 7.0 | 5.2 | 1.7 | 8.5 | 6.9 | 1.4 | 8.2 | 6.9 | 2.0 | 9.9 | 8.0 |
| 10 | 2.5 | 5.4 | 3.9 | 2.4 | 0 | 1.8 | 6.6 | 4.8 | 1.5 | 5.6 | 4.2 | 2.1 | 6.7 | 5.7 |

TABLE 7-continued

| | Wool after carbonisation | | | | | 1 hr. at 150° C | | | Heat resistance: 1 hr. at 130° C with water (pressure) | | | Heat resistance: 30 Seconds at 250° C | | |
|---|---|---|---|---|---|---|---|---|---|---|---|---|---|---|
| Trioxan content (g/l) | A.C. % | A.S. % | A.S. corr. % | U.B.S. % | U.B.S. corr. % | A.C. % | A.S. % | A.S. corr. % | A.C. % | A.S. % | A.S. corr. % | A.C. % | A.S. % | A.S. corr. % |
| 5 | 2.3 | 6.5 | 2.9 | 3.0 | 0.9 | 1.8 | 6.2 | 4.4 | 1.5 | 4.2 | 3.2 | 2.2 | 6.5 | 4.4 |

A.C. = Acid content
A.S. = Alkali solubility
U.B.S. = Urea-bisulphite solubility
corr. = Corrected value

What is claimed is:

1. A method of carbonizing cellulose material present in a substrate which also comprises noncarbonizable fibers and solvent soluble material, said method comprising the steps of:

treating said substrate with a solution of anhydrous HCl gas in an organic solvent for said solvent soluble material inert as to said non-carbonizable fibers at a temperature, for a time and at an acid concentration sufficient to achieve carbonization of the cellulose material without damage to the non-cabonizable fibers;

expressing some of said solution from said substrate; and subsequently drying the treated substrate.

2. The method of claim 1 including the additional steps of:

beating the treated and dried substrate;

rinsing said substrate after beating;

and drying the rinsed substrate.

3. The method of claim 1 wherein the treatment with said acid solution is carried out at a temperature from room temperature up to 70° C.

4. The method of claim 1 wherein the treatment with said acid solution is carried out for a period of 0.2 to 10 minutes.

5. The method of claim 1 wherein said solvent is a hydrocarbon.

6. The method of claim 1 wherein said solvent is a chlorinated alphatic hydrocarbon.

7. The method of claim 1 wherein the acid content of said solution is from 0.01 to 0.5 mol per liter of solvent.

8. A method of carbonizing wool contaminated with cellulose material and with solvent-soluble material comprising the steps of:

treating said wool with a solution of anhydrous HCl gas in an organic solvent for said solvent-soluble material which is inert as to said wool as a temperature, for a time and at an acid concentration sufficient to achieve carbonization of the cellulose material without damage to the wool and also thereby dissolving out said soluble contaminants;

squeezing said wool to express some of said solution therefrom;

and subsequently drying said wool.

9. The method of claim 1 wherein said drying is carried out at a temperature of up to 150° C for a period of up to 30 minutes.

10. The method of claim 1 wherein the treatment with the solution of acid is effected by the steps of:

impregnating said substrate with said solvent;

and treating said impregnated substrate with gaseous HCl.

11. The method of claim 1 wherein said solvent contains up to 100 g/l trioxan.

* * * * *